US007722206B2

(12) United States Patent
Anderson et al.

(10) Patent No.: US 7,722,206 B2
(45) Date of Patent: May 25, 2010

(54) UTILITY DEVICE WITH MULTIPLE, PIVOTAL NON-COPLANAR TOOLS

(76) Inventors: Wayne Anderson, 65 Grove St., Northport, NY (US) 11768; Warren Anderson, 7 Worcester Dr., Northport, NY (US) 11768

( * ) Notice: Subject to any disclaimer, the term of this patent is extended or adjusted under 35 U.S.C. 154(b) by 0 days.

(21) Appl. No.: 11/515,127

(22) Filed: Sep. 1, 2006

(65) Prior Publication Data

US 2008/0055889 A1 Mar. 6, 2008

(51) Int. Cl.
*B25B 23/18* (2006.01)

(52) U.S. Cl. ..... 362/119; 362/109

(58) Field of Classification Search ..... 362/119, 362/109, 113, 114, 120, 183, 188, 197, 200, 362/202, 208; 7/128, 138, 148, 167, 168; 81/440

See application file for complete search history.

(56) References Cited

U.S. PATENT DOCUMENTS 5,692,304 A * 12/1997 Campbell ..... 30/161
5,711,194 A * 1/1998 Anderson et al. ..... 81/440
5,916,277 A * 6/1999 Dallas ..... 7/128
6,862,764 B2 * 3/2005 Ping ..... 7/128
7,003,833 B2 * 2/2006 Feliciano ..... 7/148
7,077,540 B2 * 7/2006 Yen ..... 362/183

* cited by examiner

*Primary Examiner*—Hargobind S Sawhney

(57) ABSTRACT

A tool assembly primarily for illuminating a work space having a plurality of tools each of which having both a proximal and distal end for providing rotational movement of each of the tools for extension to at least one functional position and a distal end for use of the tool in the work space, and a stored position when not in use; in which one of said tools means is a flashlight means for illuminating at least the work space and at least one other said tools at the proximal end. The assembly further has a gripping, extension and containment portion within the assembly for engaging the tool and for providing pivotal positioning of the tools from the functional position through to the stored position; at least two non-vertically coplanar hinge pins for pivotal engagement of each of the tools from the stored position through the functional position; such that when the tools are pivoted to at least one aligned functional position the tools are substantially parallel and vertically coplanar and when the tools are pivoted to a stored position the tools are substantially contained within the assembly in a parallel, co-vertically planar arrangement by way of recesses in the said gripping, extension and containment portion; the gripping, extension and containment portion further has an arcuately sloped surface means for ergonomic and useful functioning, for wresting the flashlight or a thumb when in use.

11 Claims, 10 Drawing Sheets

UTILITY DEVICE WITH MULTIPLE, PIVOTAL NON-COPLANAR TOOLS

FIELD OF THE INVENTION

The present invention relates to the field of hand tools and more particularly to ergonomically and functionally constructed hand tools for a plurality of uses that comprise pivotal extension axes that do not reside in the same horizontal plane and pivot from open, useable position(s), to a stored, closed position within the handle, including preferably a tool flashlight that while foldable is also positionable virtually parallel to the axis of the tool and illuminates the tool and its use in the worksite.

BACKGROUND OF THE INVENTION

The instant invention relates to an ergonomically and functionally designed foldable hand tool for a plurality of uses. Hand tools are an extension of one's hands, thereby allowing the power of the hand and leverage of the forearm for increased efficacy. Human beings have used hand tools for ages, dating back to prehistoric times. Hand tools are regularly used in most occupations and are routinely used in many households and for both "do-it-yourself" and recreational use.

Typically tools are independent of one another, and thus the user must select from amongst tools in a tool box the specific tool for the specific application, requiring that the plurality of tools and tool box be carried from job to job. In order to meet this demand, a multiplicity of combined tool structures have been offered but do not carry the advantages or design of that set forth herein below.

Heretofore, foldable hand tools comprise essentially one or more tool implements arranged between a housing wherein the tool implements may be pivoted out of the stored position within the housing into an opened position outside the housing. See, for example, U.S. Pat. No. 7,003,833 to Felicano, U.S. Pat. No. 6,948,409 to Ackeret et. al., and U.S. Pat. No. 6,698,049 to McLoudrey.

It has been heretofore recognized that it is preferable to have foldable hand tool which has a means for illumination as this would eliminate the need for a separate tool. Having an illumination means included in a foldable hand tool further eliminates the need for an additional hand to hold said illumination means, therefore allowing use of the free hand for other purposes. As such, also known in the art are foldable hand tools which provide a means for illumination, such as a flashlight. See, for example, U.S. Pat. No. 7,059,741 to Elsener, and U.S. Pat. No. 7,036,952 to Zirk. The subject matter disclosed in Elsener and Zirk however, fails to disclose a device in which the illumination is virtually in axis parallel with the tool and thus actually illuminating the tool, the object of work, and the work space involved.

Moreover, the above-referenced devices fail to provide a foldable hand tool which is ergonomically and functionally designed to conform with the hand of the user. Ergonomic hand tool designs are used to improve the physical fit between people and the hand tools they use. Ergonomic tools reduce the risk of immediate, direct injuries, such as cuts and bruises. Ergonomic tools are less stressful on the hands and arms, thus minimizing the cumulative wear and tear on skin that leads to abrasions, blisters and calluses. In addition to providing for comfort during use, ergonomic hand tools also decrease the potential for injury—a consideration any prudent designer or user of hand tools must consider. Indeed, studies have revealed that hand tools were responsible for 5% to 10% of all compensable injuries. (Ayoub, M., Purswell, J., & Hicks, J. (1977). Data collection for hand tool injury: An approach. In V. Pezoldtz (Ed.), *Rare event/accident research methodology* (pp. 71-103). Washington, D.C.: National Bureau of Standards). Furthermore, 70% to 80% of hand tool related injuries were a result of use of non-power tools. Id.

Among the injuries known to be associated with hand tools are musculoskeletal disorders, both of the tendon and nerves. Musculoskeletal disorders are disorders arising from repeated exertions and excessive movements of the body. Therefore, users of hand tools, who are oft required to twist their arms, hands, and wrists repeatedly or forcefully are susceptible to musculoskeletal disorders. Musculoskeletal disorders are often painful and are usually involve debilitating swelling. Among the known musculoskeletal disorders associated with use of hand tools are carpal tunnel syndrome, tenosynovitis, tendinitis, ganglionic cyst, epicondylitis, and De Quervain's disease. According to the U.S. Bureau of Labor Statistics (1990), the incidence of musculoskeletal disorders is quickly rising. Indeed, more than 60% of the workplace illnesses reported each calendar year are associated with musculoskeletal disorders. Other symptoms associated with musculoskeletal disorders are tingling, swelling in the joints, decreased ability to move, decreased grip strength, continual muscle fatigue, sore muscles, numbness, and pain in movement. Often one can associate the condition with the design (i.e., the device is awkward in holding and implementation) and with the inability to illuminate the working environment (often a flashlight is held in the mouth of the user to provide light to the working environment).

It is thus an object of the instant invention to overcome these aforementioned limitations in a single operational design.

Ergonomically and functionally designed hand tools have also been shown to decrease the amount of force needed for work. Hand tools that require muscular force should be designed so that the largest muscle groups available exert the required force. Utilization of the largest muscle groups will enable users of hand tools to apply much greater torque than can be accomplished with a non-ergonomically designed hand tool, without risk of injury. The greater the force exerted by use of a hand tool, the greater the strain on the user's hand and arm. Ergonomic hand tools enable users to apply two to three times the torque available from conventional hand tools.

It is thus another object of the instant invention to provide a functional, ergonomically constructed tool array that reduces the risk of injury while still permitting use of the user's musculature in operation.

Accordingly, it has been recognized that use of ergonomically constructed and functional hand tools will reduce health claims. According to the Occupational Safety & Health Administration (OSHA) companies that implement ergonomic means with function can reduce the number of repetitive motion and back injury claims by more than 250,000 annually. Functional and ergonomic hand tools improve the user's overall productivity by reducing the risk of both direct and long-term injury.

This and other objects of the instant invention will become evident by careful reading and analysis of the within application and review of the annexed figures.

SUMMARY OF THE INVENTION

The various features of novelty which characterize the present invention are expressly and unambiguously delineated in the claims annexed to and forming part of the disclosure. For a better understanding of the present invention, its practical advantages, and specific objects attained by its use, reference should be had to the drawings and descriptive matter in which there are illustrated and described preferred embodiments of the invention.

Shown is a tool assembly primarily for illuminating a work space having a plurality of tools each of which having both a proximal and distal end for providing rotational movement of each of the tools for extension to at least one functional distended position and a distal end for use of the tool in the work space, and a stored functional position, in which one of said tools means is a flashlight means for illuminating at least the work space and at least one other said tools at the proximal end.

The assembly further has a gripping, extension and containment portion within the assembly for engaging the tool and for providing pivotal positioning of the tools from the functional distended position through to the functional stored position; at least two non-vertically coplanar hinge pins for pivotal engagement of each of the tools from the functional stored position through the functional distended position; such that when the tools are pivoted to at least one aligned functional distended position the tools are substantially parallel and vertically coplanar and when the tools are pivoted to a functional stored position the tools are substantially contained within the assembly in a parallel, co-vertically planar arrangement by way of recesses in the said gripping, extension and containment portion; the gripping, extension and containment portion further has an arcuately sloped surface means for ergonomic and useful functioning, for wresting the flashlight or a thumb. Multiple tools may also be used in lieu of the flashlight.

The weight of the instant invention is light enough so that the user may operate the desired tool(s) with one hand. Therefore, the weight of the entire device, especially for repetitive use, should optimally be less than 2 pounds. The center of gravity of the instant device should be as close to the hand location as possible. Indeed, if the center of gravity is away from the hand, more force is required to maintain control of the desired tool implement. In the instant invention, a substantial center of gravity is achieved in that the respective hinge pins are non-coplanar and the attached tool implement of roughly equal weight. Furthermore the hand tool of the instant invention has a substantial center of gravity so as not to remove the "feel" of the device.

It is critical to the instant invention that the center of gravity of the instant device be substantially aligned with the user's hand and arm. As such, the desired tool implement of the instant device, when in the distended functional position, will be in-line with the gripping, extension and containment portion. Having the tool implement in-line with the gripping, extension and containment portion will allow the user's wrist posture to remain straight, so as to avoid injury. This is critical in that as the wrist posture deviates from the straight position, the amount of grip force that a person can apply to a hand tool decreases proportionally. Indeed, it is recognized that maintaining a user's hands and arms in alignment will reduce the risk of musculoskeletal disorders and other injury during even prolonged hand tool use.

The contour of the gripping, extension and containment portion of the instant device is large enough so as not to cause discomfort, and to help distribute forces on fingers. The contour of the gripping, extension and containment portion permits the even distribution of forces over the largest area of the hand possible.

Optimally, the gripping, extension and containment portion of the instant invention resides between 3.75 and 5 inches in length to extend across the entire breadth of the palm to allow the user to apply a power grip. Gripping, extension and containment portions larger than 4 inches will typically reduce the negative effects of any compression exerted. Additionally, the gripping, extension and containment portion resides in a diameter of between 1.25 to 2 inches, depending on the amount of torque required. The greater the torque required, the greater the diameter of the gripping, extension and containment portion.

In order to minimize the gripping force needed to hold the instant device, ample friction must exist between the hand and the gripping, extension and containment portion. To avoid slipping, the grip of the gripping, extension and containment portion is preferably made of non-slip, non-conductive, compressible materials.

Other features will become apparent from reading the disclosure and claims of the instant invention.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
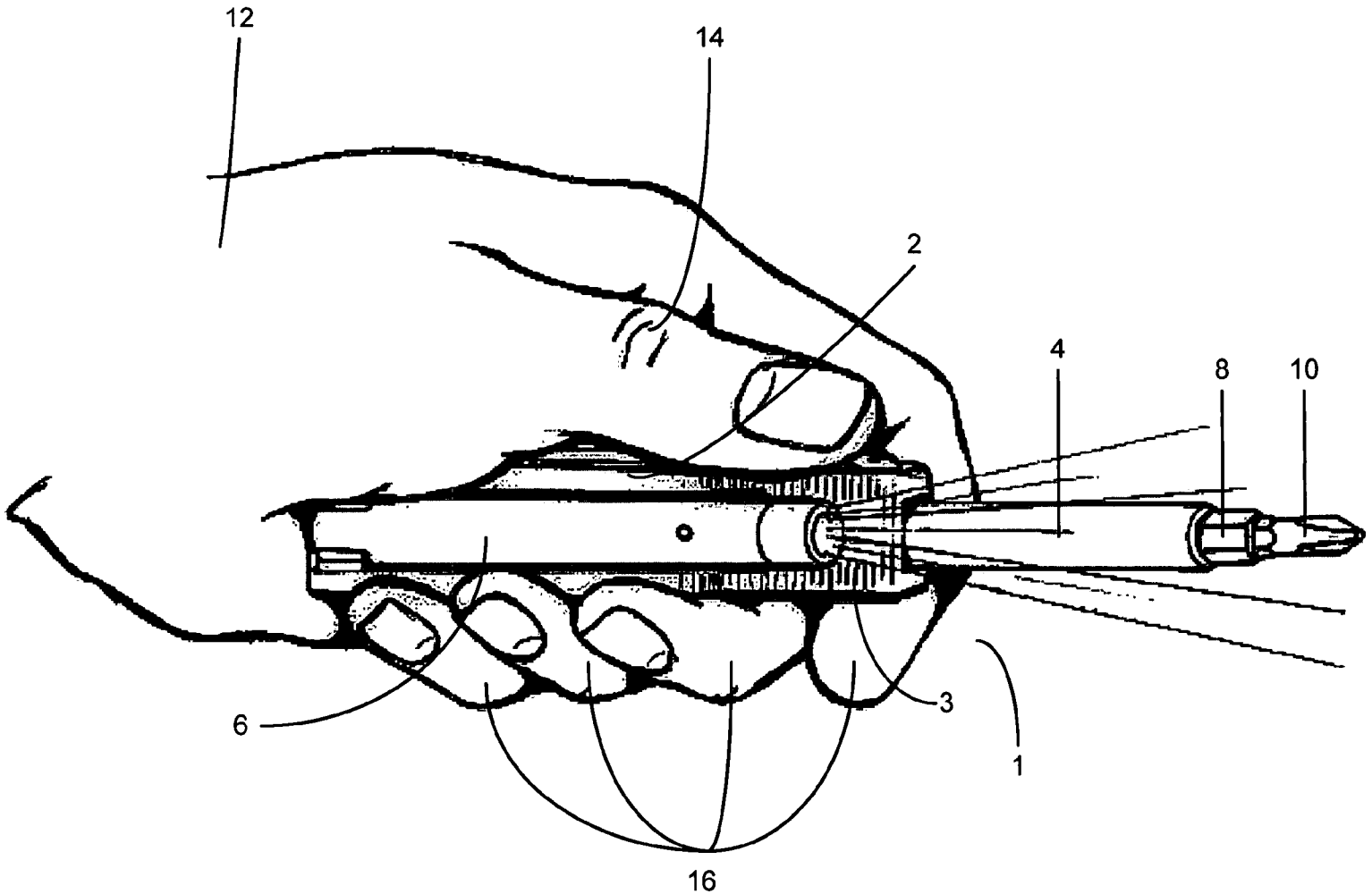
FIG. 1 is a perspective view showing pivotal illumination of a tool in use in accordance with the preferred embodiment of the subject invention.

As shown in FIG. 1, the preferred embodiment of the present invention is directed to device 1 which permits the use of two tools simultaneously, in this case flashlight 6 and Phillips head 10. As shown, flashlight 6, in the stored functional position, can illuminate the tool means, in this instance a Phillips head 10, and the screw (not shown but understood to exist) to which it will engage, in a manner in which the illumination is virtually in parallel with the tool and thus actually creates light for the work space and the work involved. Such a combination is heretofore unknown.

Moreover, and in particular, hand 12 of a user engages by way of fingers 16, handle 2 of device 1 and via thumb 14, rests upon a textured thumb grip 3 of specific configuration to create a power gripping effect as discussed in greater detail herein below. As a result of the dimensions, flashlight 6, folded in the stored position, as shown, is such that the entire device 1, save the tool means (comprising shaft 4, housing 8 and Phillips head 10) fits firmly in hand 12. Thus, it should be observed by one of ordinary skill in the art that the tool and workspace are illuminated in a unique manner by device 1 which fits neatly into hand 12 of the user providing illumination with a sturdy and efficient gripping and driving device, together 1.

It should be further appreciated that flashlight 6 is not required for the user to have that sturdy and efficient gripping. Rather, flashlight 6 can, as shown by reviewing the remaining figures, be folded into the bottom of handle 2 tucking it away, protecting the same, and preventing its intrusion into the use of Phillips head 10. In this manner, device 1 maintains its gripping and driving ability because of its size in respect of hand 12, even without the use of flashlight 6.

Thus, it becomes evident that flashlight 6 moves rotationally less than 360° from functional distended position (like that of FIG. 1-3) to tuck away under handle 2, as necessary for use by the user. This configuration of a flashlight and tool implement allows usage at night and in dark places, while also providing use where additional illumination is not required.

It should be understood that the flashlight portion of the subject embodiment is critical, yet the tool, in FIG. 1 Phillips head 10, can be of many different tool means. For example by removing Phillips head 10 and housing 8, shaft 4 as shown becomes a hexagonal socket device. This is accomplished by rendering housing 8 in a hexagonal fashion. It should be further understood, that a multiplicity of different sized shafts 4 can be employed depending upon the hexagonal wrenching required, and concentrically fitted housings 8 are then employed one for each.

Figure 2:
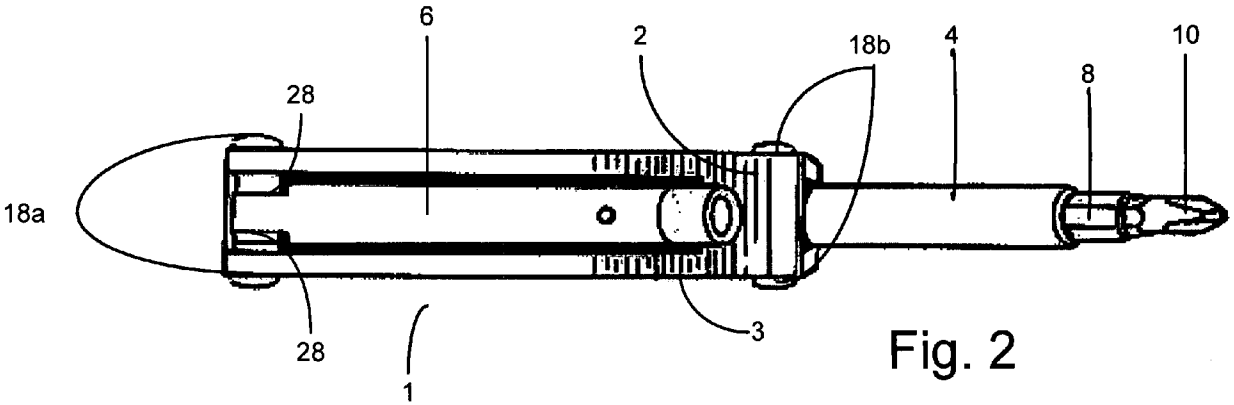
FIG. 2 is a top-down perspective view in accordance with the preferred embodiment of the subject invention as shown in FIG. 1.

As shown in FIG. 2, hinge pin 18B creates the pivot point for shaft 4. Thus, it can be observed that by rendering hinge pin 18B in a removable manner, a multiplicity of shafts 4 of different dimensions can be employed for the reasons set forth immediately above. Key, however, is that the length of shaft 4 be such that it fit smoothly into handle 2, tucking away such that the head is in the curvalinear section, shown as 22*a* in FIG. 3.

Figure 3:
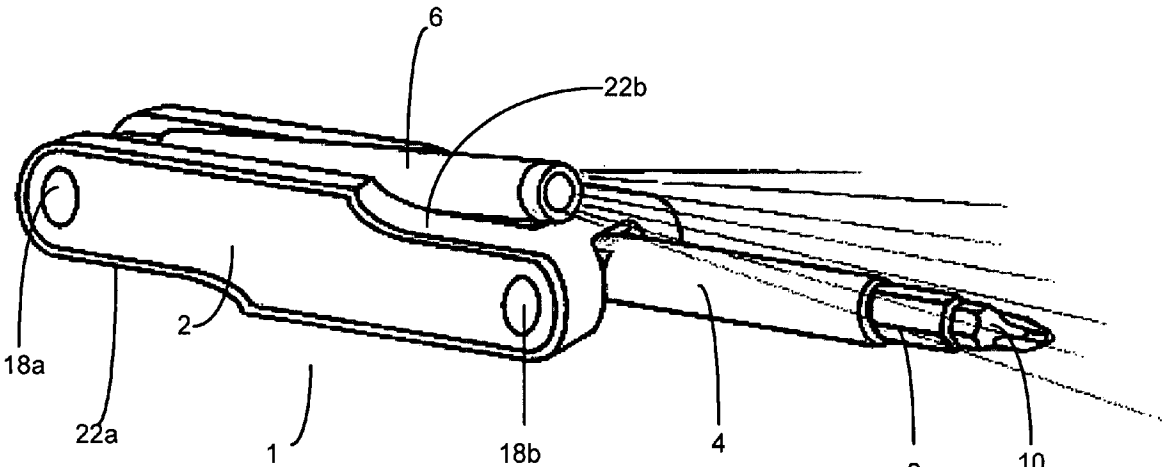
FIG. 3 is a side perspective view in accordance with the preferred embodiment of the subject invention as shown in FIG. 1.

As shown in FIG. 2, flashlight 6 pivots along hinge pin 18A such that when in the fully extended view of FIG. 2 flashlight 6 generally aligns with shaft 4 for proper illumination as shown in FIG. 3.

FIG. 3 shows a side view which is critical in that the conformation of handle 2 is displayed. Of critical significance to this embodiment are the dual arcuate cutouts 22A and 22B for accommodating both the tools when stored, and the flashlight 6 (for 22A) when in the stored functional position. As shown below, this design also accommodates the placing of a thumb in the arcuate cutout which enables the device to be a physiological extension of the forearm of the user for greater torque and related action, as explained further herein below.

Figure 4:
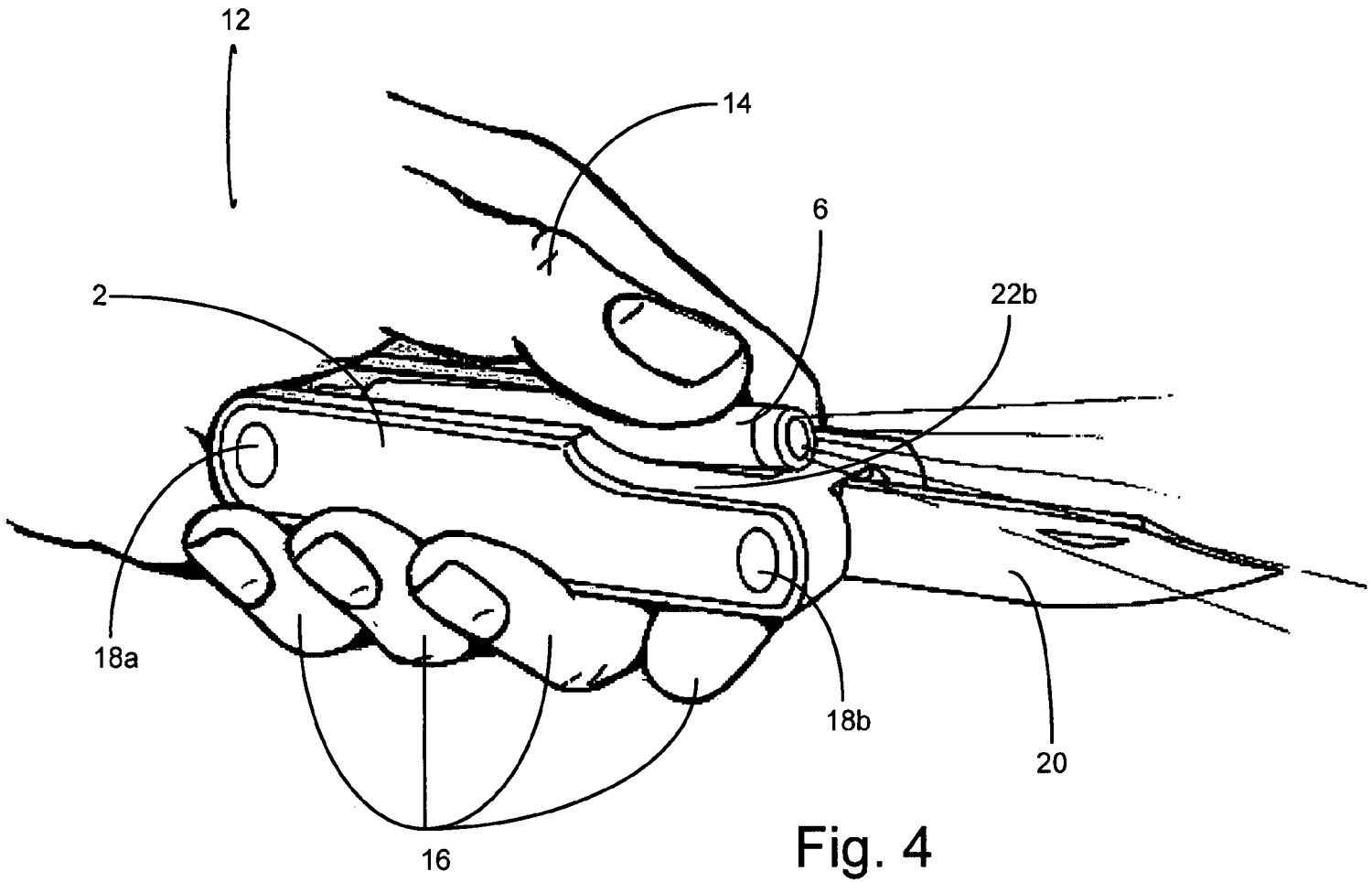
FIG. 4 is a perspective view showing pivotal illumination of an alternative tool in use in accordance with the preferred embodiment of the subject invention.
Figure 5:
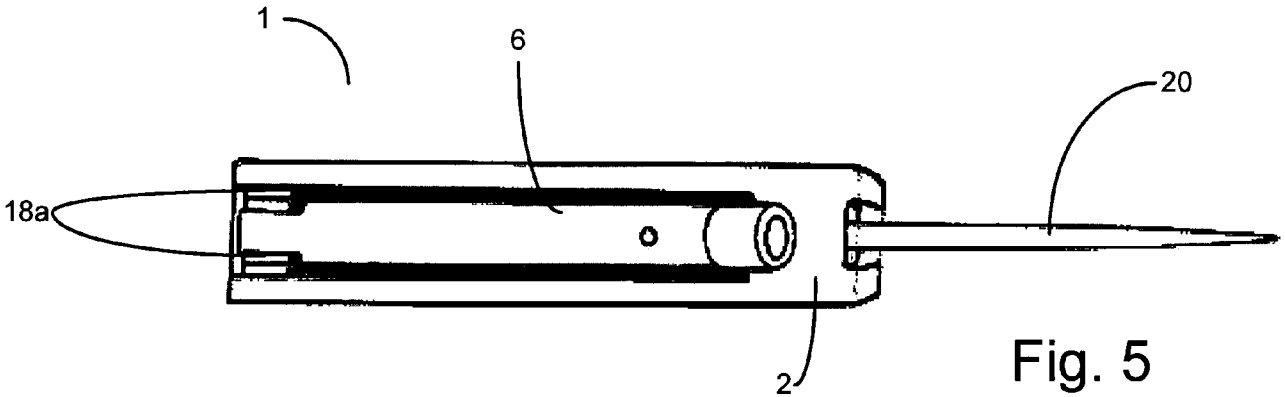
FIG. 5 is a top-down perspective view in accordance with the preferred embodiment of the subject invention as shown in FIG. 4.
Figure 6:
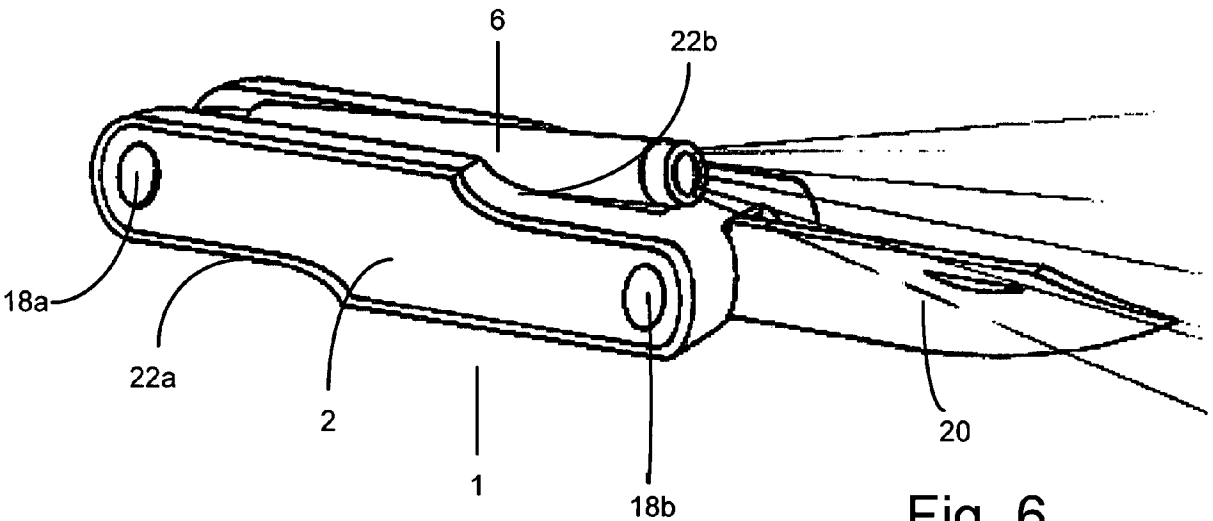
FIG. 6 is a side perspective view in accordance with the preferred embodiment of the subject invention as shown in FIG. 4.

As can be appreciated, a multiplicity of tools can be utilized in place of Phillips head 10 in connection with flashlight 6 as shown in FIGS. 4-6 which has blade 20 therein but otherwise conforms with the same elements as those hereinabove set forth, functioning in the same manner.

Figures 7, 8, 9:
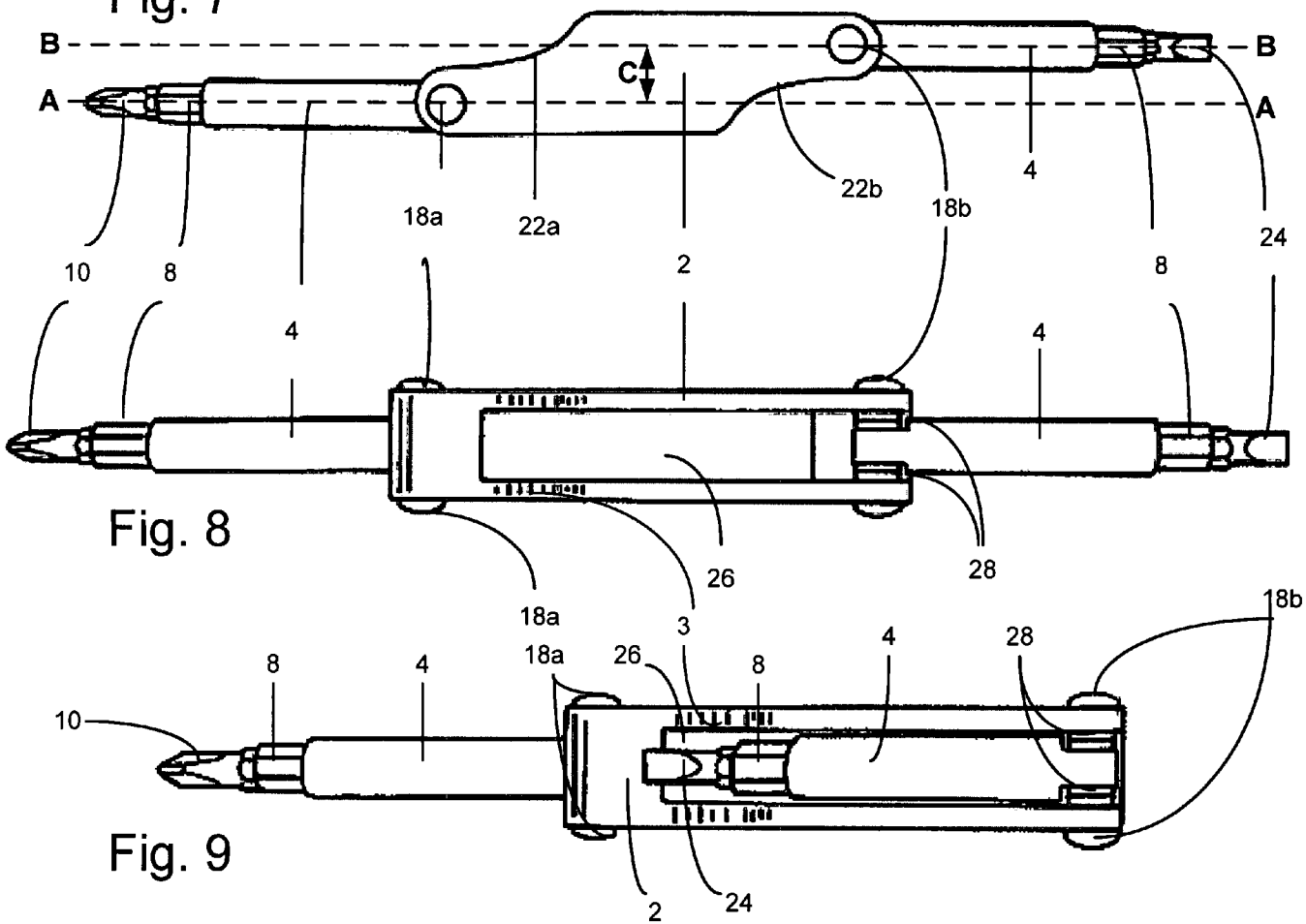
FIG. 7 is a side, planar view of an alternative preferred embodiment of the subject invention having a multiplicity of tools in extended fashion.
FIG. 8 is a top down view in accordance with the alternative preferred embodiment of the subject invention having a multiplicity of tools in extended fashion.
FIG. 9 is a top down view in accordance with the alternative preferred embodiment of the subject invention having a multiplicity of tools with one in extended fashion and one in closed fashion.

So, too, it can be appreciated that the device can also accommodate a plurality of tools wherein neither of the tools are a flashlight. In particular, FIGS. 7-9 show an alternative preferred embodiment wherein Phillips head 10 and flat head 24 are both in use and, in FIG. 9 at least one in folded position contained in handle 2. Consistent to handle 2 is the non-coplanar positioning of hinge pins 18A and 18B. As shown in FIG. 7, hinge pin 18A is indicated in plane A and hinge pin 18B in plane B, such that a distance C separates the planes. This conformation is critical to the subject invention as it permits the tools to fold into handle 2 such that one stores above and one stores below relative to handle 2. When folded inwardly, the tool is stored compactly without interfering with the use of the other tool, and when folded outwardly is available for usage.

Figure 10:
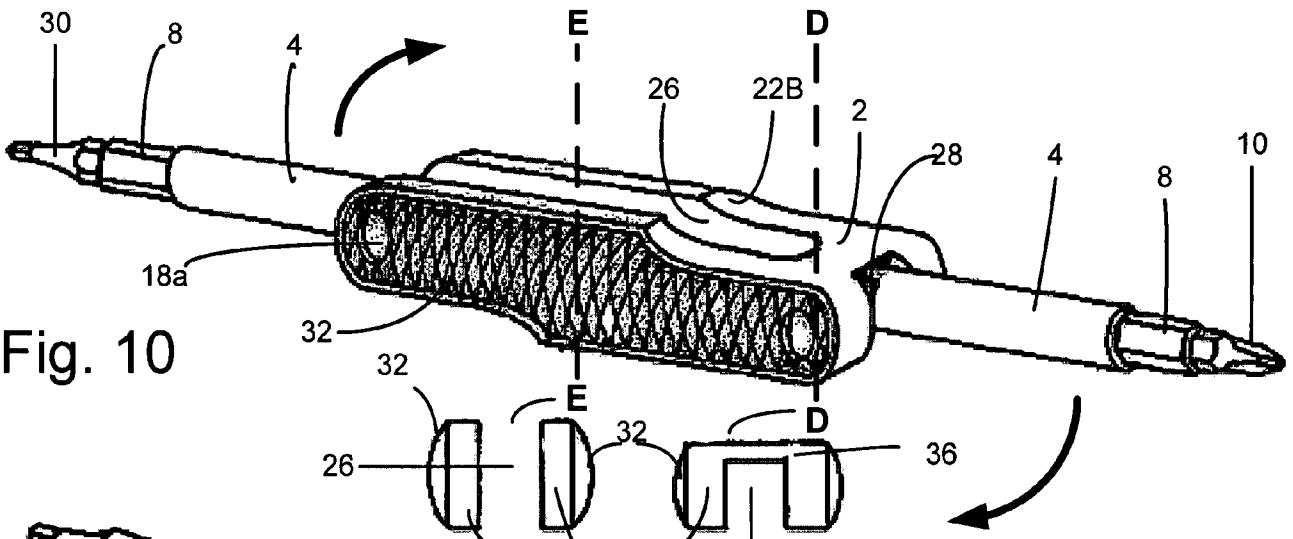
FIG. 10 is a perspective view in accordance with the alternative preferred embodiment of the subject invention having a duality of tools in extended fashion showing a gripping means and seating and stop means for the tools when extended.

FIG. 10 indicates the alternative preferred embodiment wherein Phillips head 10 is utilized on one side, and a square recess bit 30 on the other. Arrows shown in FIG. 10 indicate the variability of movement.

Figure 11:
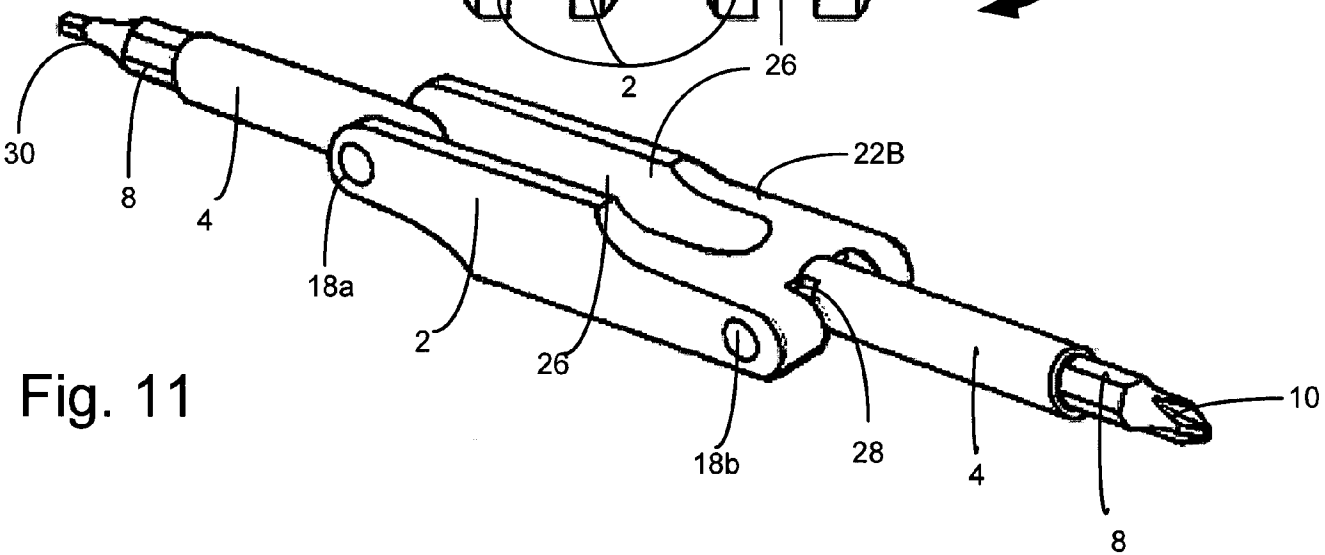
FIG. 11 is a perspective view in accordance with the alternative preferred embodiment of the subject invention having a duality of tools in extended fashion without gripping means.

Likewise, FIG. 11 shows virtually the same conformation as in FIG. 10 from a different perspective, without cladding 32 and without housing 8. Most visible is the arcuate cutout 22B (which is identical to 22A, but not visible in this figure) with trough 26. The configuration of cutout 22 and trough 26 are critical in that it provides multiple functions, including: (a) a means for placing the tool so that the handle is strengthened and the tool out of the way when not in use; (b) a means for placing flashlight 6 (as shown above) for illuminating the work space while also providing a means for storage; and (c) a thumb grip (see, e.g., FIG. 16) which enables the user to employ the device in a manner such that it virtually becomes an extension of the user's hand and forearm, providing greater strength and torque action. These are distinctive features of the instant invention.

Also visible in FIG. 10 are the stop 36 which is essentially a cross-section along line D which shows that shaft 4 cannot be raised greater than full alignment with handle 2 (hence approximately 180° from its storage position) and thus will not "wiggle" about when in use. Likewise, cross section E shows that the tool (via shaft 4) spins in a singular direction to dispose flashlight 6 in either an operational or closed position.

Figure 12:
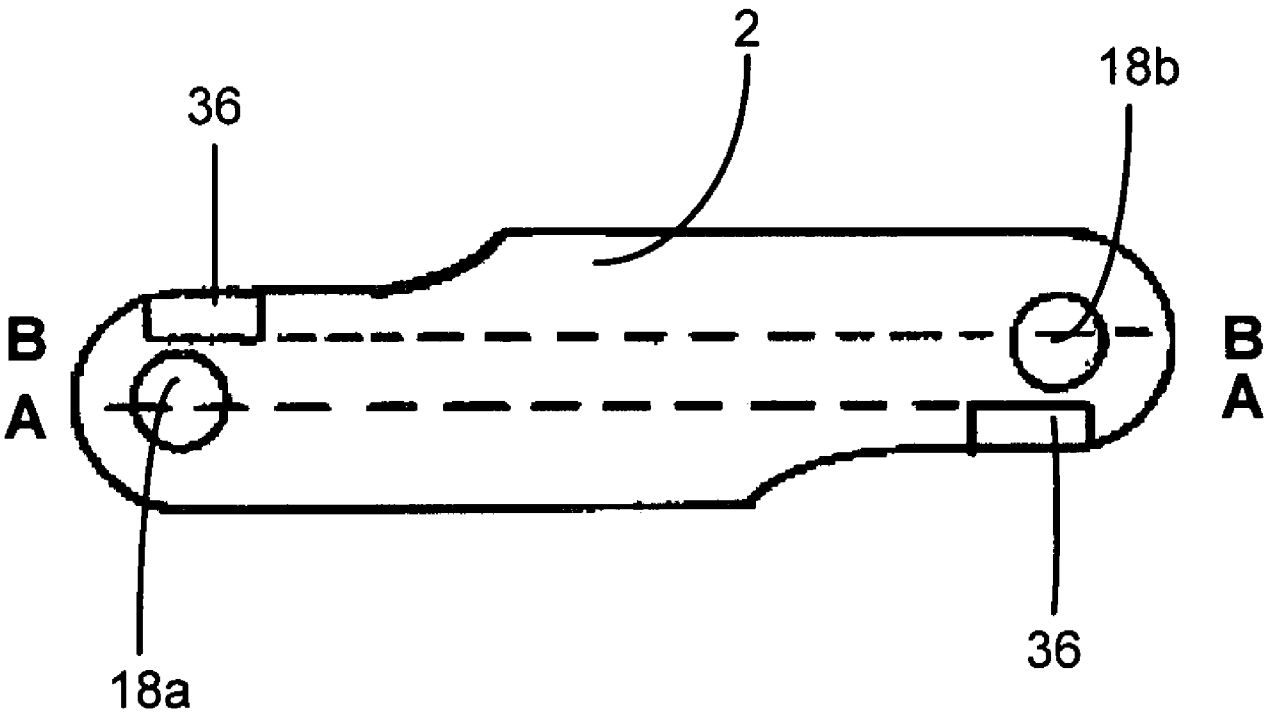
FIG. 12 is a cross-section of the handle of the alternative preferred embodiment in accordance with the subject invention as shown in FIG. 11.

FIG. 12 is a cross-sectional view of handle 2 showing the differential between planes B and A as explained hereinabove, as well as hinge pins 18A and 18B. Stops 36 are represented to prevent further movement of tools when in storage position. Obviously, in the instances in which flashlight 6 is engaged, that position will not include a stop 36 so as to allow for the approximately 190° rotation.

Figure 13:
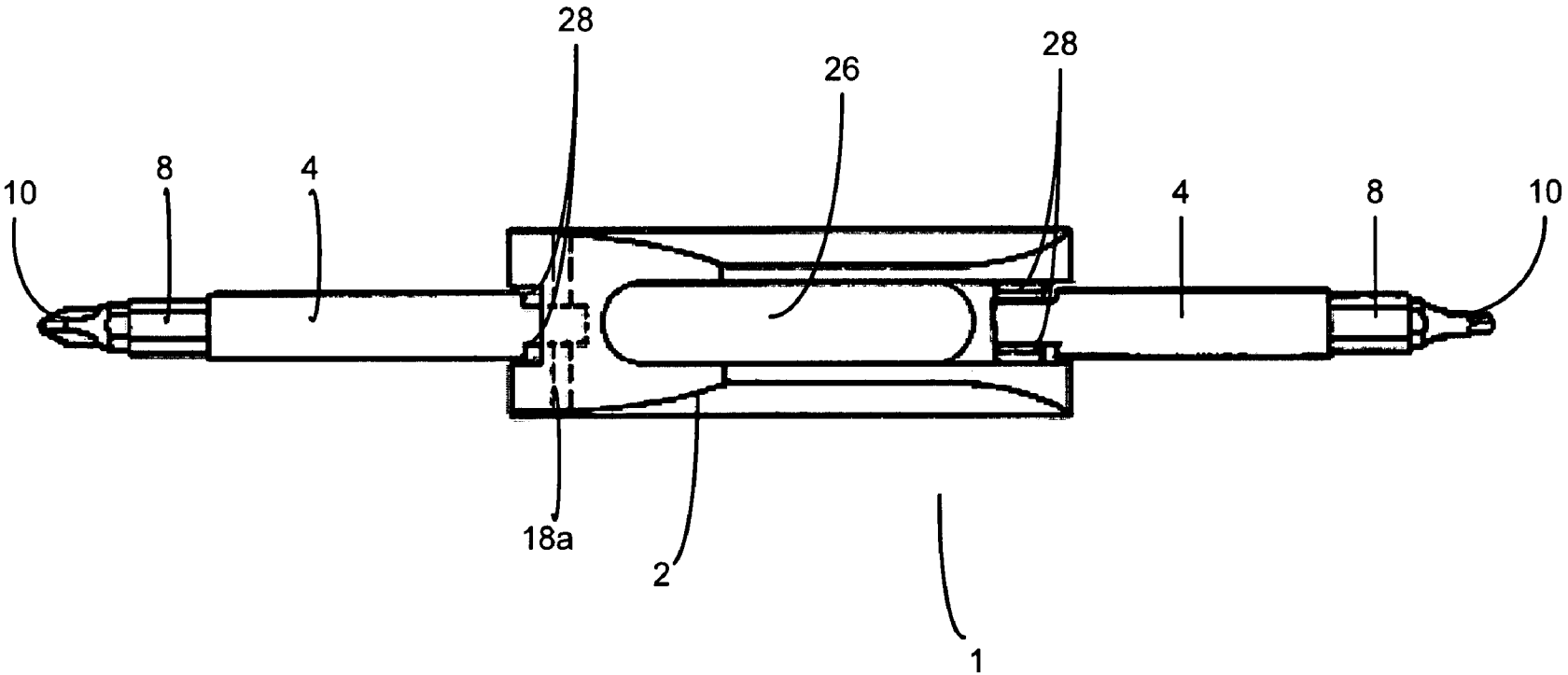
FIG. 13 is a top view of the alternative preferred embodiment in accordance with the subject invention as shown in FIG. 10.

FIG. 13 shows a handle 2 and also shows hinge pin 18A which is the "C" housing shown by cross section D in FIG. 10, thereby impeding the motion beyond the closed position wherein the tool is substantially coplanar with the handle. Likewise, the other side of handle 2 permits pivoting as in the instance of use of flashlight 6 as shown, e.g., in FIG. 1 and in FIG. 13 as square bit 10.

Figures 14, 15:
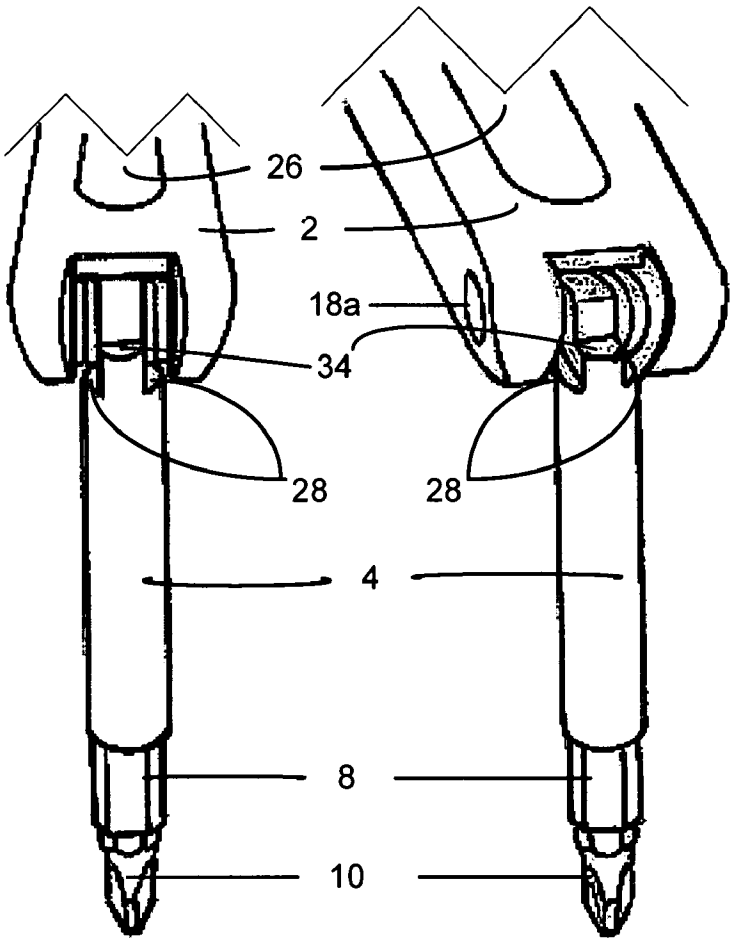
FIG. 14 is a perspective view of a portion of the preferred embodiment of the subject invention wherein the tool is in a semi-extended view.
FIG. 15 is a perspective view of a portion of the preferred embodiment of the subject invention wherein the tool is in a semi-extended view.

FIGS. 14 and 15 reflect tang 34 which prevents shaft 4 from moving beyond a coplanar arrangement with handle 2; i.e., no more than about 180° from the closed position. As observable the clipping arrangement places tang 34 in an arrangement such that tang 34 hits stop 36 of handle 2 (see FIG. 10 as well for further demonstration thereof).

Figure 16:
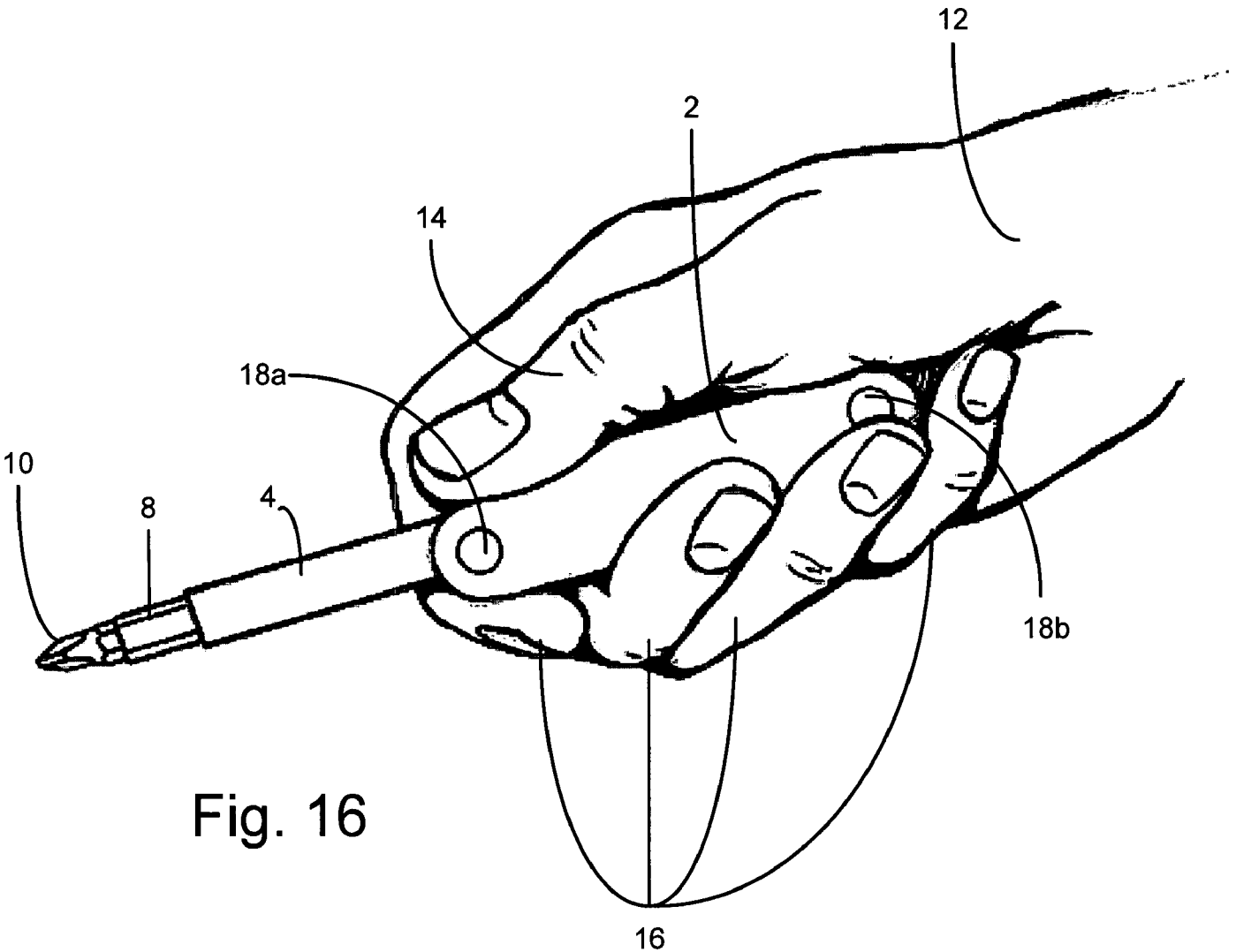
FIG. 16 is a perspective view of the subject invention in the hands of a user engaged for us, in accordance with a preferred embodiment of the subject invention.

FIG. 16 shows device 1 with an extension of Phillips head 10 on housing 8 upon shaft 4 turned about pin 18A and fully extended. As a result of the configuration, including the arcuate shape of handle 2, device 1 ergonomically fits well in a user's hand creating an extension thereof and permitting the synergistic interplay between device 1, hand 12, and forearm (not shown but understood) in a manner that increases torque and other related actions rendering the tool the equivalent of one having a handle that travels virtually the full distance between the head 10 and elbow of the user.

While there have shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the invention, therefore, to be limited only as indicated by the scope of the claims appended hereto.

We claim:

1. A tool assembly for illuminating a work space, the tool assembly having a tool means cavity and a flashlight means cavity on opposing sides of the assembly, comprising;

(a) tool means having both proximal and distal ends wherein said proximal end rotationally moves about a first pivot in the assembly for extension to at least one open tool position such that the distal end is useable in the work space, and a closed tool position when not in use for storage wherein said tool means is housed in the tool means cavity of the assembly;

(b) flashlight means for illuminating at least the work space and said tool means, said flashlight means having both a proximal and distal end wherein said proximal end rotationally moves about a second pivot in the assembly between a primary flashlight position, wherein said flashlight means is contained in the flashlight means cavity and said illumination is provided to said tool means and the work space, and a secondary flashlight position, wherein said flashlight means is housed in the assembly substantially in the tool means cavity;

(c) gripping, rotational and containment means within said assembly for grippable engagement of said tool means and said flashlight means, and for said pivotal rotational movement, wherein the tool means cavity and flashlight means cavity on opposing sides of the assembly are provided such that the tool means cavity contains said flashlight means when said tool means is in said open tool position and the flashlight means cavity contains said flashlight means when said illumination is provided; and (d) wherein said pivots are disposed in a vertically non-coplanar arrangement within the gripping, rotational and containment means for pivotal engagement of each of said tool means and flashlight means.

2. The assembly of claim 1 wherein said second pivot for said flashlight means provides pivotal motion as functionally necessary from to approximately 0° in said secondary flashlight position to approximately 330° in said primary flashlight position for illuminating said tool means and the work space.

3. The assembly of claim 1, wherein said gripping, rotational and containment means further comprises an arcuately sloped surface means for ergonomic and useful functioning. such that said arcuately sloped surface means comprises two arcuate sides and said recess there between, such that said recess provides removable entry and storage of said tool means and said flashlight means in said positions.

4. The assembly of claim 3, wherein said arcuately sloped surface comprises a stop means upon which said flashlight means lays when in said primary flashlight position .

5. The assembly of claim 3, wherein said sloped surface means provides a thumb rest.

6. The assembly of claim 1, wherein said tool means is selected from the group consisting of hexagonal wrenches, knives, screwdrivers, threading tools, cutting tools, driving tools, removing tools, lazar means, and bits.

7. The assembly of claim 1, wherein said gripping, rotational and containment means further comprises means for preventing said tool means from extending beyond approximately 180° from said closed tool position.

8. The assembly of claim 7, wherein said preventing means comprises a tang at said proximal end of said tool means and a flat mid-section of a "C"shaped housing to which it engages for prevention of further movement and interlocking therein.

9. The assembly of claim 1 wherein said tool means comprises a sleeve in which at least one tool is insertable.

10. A cased hand tool comprising a handle having parallel sides with opposing disposed ends, further comprising:

(a) a plurality of pivotable tool means having two working ends for attachment to each respective end of at least one tool such that one tool is stored on one side of the case and the other tool stored on the opposite side of the case such that said tool means have said working ends stored in opposing directions wherein when one working end tool means is disposed substantially 180 degrees from the stored direction and the other remains at substantially 0 degrees in the stored direction, both tool means point in the same direction; and (b) one of said tool means comprises a tool bit means with 4 tool bit ends and 3 hexagonal openings and said second tool means comprises a flashlight such that said tool means and said flashlight illuminate said tool bits means and work space when said flashlight is in the substantially stored 0 degree position and said tool means is disposed 180 degrees from the stored direction, such that the tool bit means is operable in the disposed position and the flashlight is operable both in the disposed position and in the substantially stored position.

11. The hand tool of claim 10 wherein the diameter of the working end housing said flashlight is reduced and contoured to provide a resting place for a user thumb when the flashlight is engaged to enable lighting directly at the other tool means when in the substantially non-disposed position and allows access to an onloff switch and/or focusing means of the flashlight while in said substantially non-disposed position.

* * * * *